United States Patent [19]

Brauer et al.

[11] 4,191,041

[45] Mar. 4, 1980

[54] ROLLING MILLS

[75] Inventors: Hans Brauer, Leichlingen; Werner Demny, Dusseldorf, both of Fed. Rep. of Germany

[73] Assignee: Friedrich Kocks GMBH & Company, Dusseldorf, Fed. Rep. of Germany

[21] Appl. No.: 917,191

[22] Filed: Jun. 20, 1978

[30] Foreign Application Priority Data

Sep. 17, 1977 [DE] Fed. Rep. of Germany ..... 2741962

[51] Int. Cl.[2] ..... B21B 1/18

[52] U.S. Cl. ..... 72/235

[58] Field of Search ..... 72/234, 235, 227, 224, 72/226

[56] References Cited

U.S. PATENT DOCUMENTS

| | | | |
|---|---|---|---|
| 3,129,618 | 4/1964 | Hergeth | 72/224 |
| 3,380,278 | 4/1968 | Dilling | 72/224 |
| 3,498,097 | 3/1970 | Mishuku | 72/234 |
| 3,566,657 | 3/1971 | Blinn | 72/234 |
| 3,600,924 | 8/1971 | Martin | 72/224 |

*Primary Examiner*—Milton S. Mehr

*Attorney, Agent, or Firm*—Buell, Blenko & Ziesenheim

[57] ABSTRACT

A rolling mill for rolling wire or rod product having a plurality of roll stands arranged one after the other, each having at least three driven rollers and in which the distance between at least two adjoining successive stands forming a group is not substantially greater than the roller diameter of the stands and the last sizing pass of each group of stands has a regular cross section in relation to the first sizing pass of the next following group.

7 Claims, 6 Drawing Figures

A
B
D
II
1
2
3
4
5
6
7
8
9
10
11
12

ROLLING MILLS

The invention relates to rolling mills and particularly to a multi-stand rolling mill for rolling wire or a rod-shaped product, such a hot-rolled product.

In known multi-stand rolling mills, guide elements for the product to be rolled are located between the roller stands and engage the wire or rod to ensure that the wire or rod enters the sizing pass of the following roller stand in a satisfactory manner, and, in particular, ensure that the product does not turn or twist about its longitudinal axis. The twisting of the wire or rod can lead to serious rolling errors, and particularly to irregular cross-sectional shapes and dimensional errors. In order to be able to fulfill their purpose, the guide element used for this reason have to abut closely against the product to be rolled. A large number of various constructions of guide elements of this type is known, although they all have disadvantages (even though they have these disadvantages to differing extents) which considerably impair the operational reliability and the economy of the rolling mills, as well as their efficiency.

A substantial disadvantage of these guide elements resides in the fact that they are subjected to a considerable amount of wear owing to the fact that they are in direct contact with the product to be rolled, so that the guide elements or parts thereof continuously have to be changed. The replacement parts, as well as the labor and time cost for changing the replacement parts, constitute a substantial portion of the operating costs. Furthermore, the known guide elements have to be observed and inspected even during operation. Furthermore, when the rolling program is changed, it is necessary to at least re-adjust the guide elements and, in many types of construction, they have to be fully exchanged. Since the guide elements have to be accurately aligned with the rolling axis, and this is difficult to carry out with many types of construction, a third of the total preparation time may be required solely for adjusting the guide elements. Guide elements of this type also frequently cause surface flaws on the product to be rolled, and trouble during the rolling operation as a result of work-material jamming in the guide elements. Furthermore, owing to the above-mentioned disadvantages of these guide elements, a larger number of personnel is required to operate the rolling mill, particularly when the program is changed. Finally, guide elements of this type constitute a considerable obstacle in the development of rolling mills for rolling speeds higher than those customary at the present time.

The present invention provides a rolling mill for rolling wire or rod-shaped product having a plurality of stands which are arranged one after the other and form a block and each of which has at least three driven rollers, in which guide elements abutting against the work-material to prevent the work-material from rotating about its longitudinal axis between the roller stands are absent and in which the distance between at least two adjoining stands forming a group is not substantially greater than the roller diameter of those stands and the last sizing pass of such group of stands of the block has a regular cross-sectional shape, in relation to the first sizing pass of the next following group.

The absence of any guide elements in the first instance results in the elimination of all labor and costs both for manufacturing such guide elements and for servicing and operating them. In the event of a change of program, the time spent on adjusting the rolling mill is considerably shortened. Furthermore, there can be a saving on operating personnel. A further advantage is that the surface of the work-material is only contacted by the rollers of the roller stands and is thus protected. Surface flaws, such as abrasions and pinching caused by guide elements, no longer occur. There is also no longer the risk of the relatively frequent trouble caused by scale in the region of the guide elements. The greater operational reliability of the rolling mill thus achieved is an essential prerequisite for obtaining greater rolling speeds and thus improving the performance.

The advantageous omission of any guide elements is rendered possible by virtue of the fact that, in accordance with invention, the distance between at least two adjacent roller stands is also at the same time kept very small and, in general, is equal to or less than the roller diameter. It is still possible for the inter-stand spacing to exceed the roller diameter slightly by, for example, 10 or 15 millimeters, although this should be avoided. It is more advantageous to keep the distance between the stands as small as possible. A rolling mill in accordance with the invention can be constructed in which all the distances between the stands can be kept extremely small in the manner previously mentioned. However, in the case of a rolling block having a large number of stands, this could lead to servicing and operating difficulties.

Furthermore, it always has to be taken into account that the work-material might jam within the rolling mill. It is then difficult to remove the work-material in the case of extremely small distances between the stands. Therefore, a rolling mill in accordance with the invention, in which all the stands are very close together, will be the exception in practice, since they are only recommended for low rolling speeds and small reductions. A rolling mill is preferred in which, after each second or third stand, there is a greater distance between one stand and the following stand. This greater distance between the stands can amount to two times or seven times the roller diameter. It will be appreciated that it is also possible to provide this greater distance between the stands after an even greater number of stands which follow closely one after the other.

In accordance with the invention, no guide elements which abut against the work-material, and which prevent the latter from turning about its longitudinal axis, are provided in the region of this larger distance between the stands. This is rendered possible by a further feature of the invention according to which each last sizing pass, viewed in the direction of rolling, of the groups of stands, formed by the stands arranged closely one behind the other, produces a regular cross-sectional shape, such as that of a circle or of a regular hexagon. In this manner, the work-material is provided with a cross-sectional shape which renders it possible to omit guide elements which prevent the turning of the work-material. Namely, for work-material having for example a circular cross-section, it is entirely immaterial whether the work-material is, or is not, turned or twisted slightly when it enters the next following sizing pass beyond the larger distance between the stands. The same applies in the case of a regular hexagonal cross-section in the case of three roller stands. If the work-material has turned in the last-mentioned case, it is either turned into the original position, or it turns through exactly 60 degrees, upon entering the next following triangular sizing pass, this also not being disadvantageous especially since, owing to the following, extremely small distance to the next stand, it is impossible for the work-material to continue turning through an even greater angle.

Thus, in the rolling mill in accordance with the invention, the disadvantageous guide elements can be omitted and coarse guides, known as entry funnels, can be used exclusively. Coarse guides of this type do not normally engage the work-material and are only contacted by the work-material if the latter should deviate from the rolling axis to an extreme extent and there is the risk that the leading end portion of the work-material will emerge from the rolling mill laterally, upwardly or downwardly. The inside width of these coarse guides is so large that the coarse guides normally do not come into contact with the work-material, and accurate adjustment is unnecessary. These known coarse guides are not to be confused with the above-mentioned guide elements.

In a preferred embodiment of the invention, each group of stands of the block comprises two roller stands, and a larger distance of from twice to seven times the roller diameter exists between the groups of stands. In this embodiment, it is advisable to vary the cross-sectional shape of the sizing passes from roller stand to roller stand between a triangular oval and a circle, or between a triangle and a hexagon. In this connection, the term "triangular oval" refers to a substantially triangular sizing pass in which the corners of the triangle are greatly rounded and the sides of the triangle are distinctly convex. In another embodiment of the invention, in which several roller stands are arranged one behind the other at extremely short distances apart, a plurality of sizing passes having a triangular oval cross-section or a triangular cross-section are also arranged one behind the other, and only the last sizing pass before a larger distance between stands is of circular or hexagonal configuration.

The invention is further described, by way of example, with reference to the accompanying drawings, in which.

Figures 1, 1A, 1B, 1C, 1D:
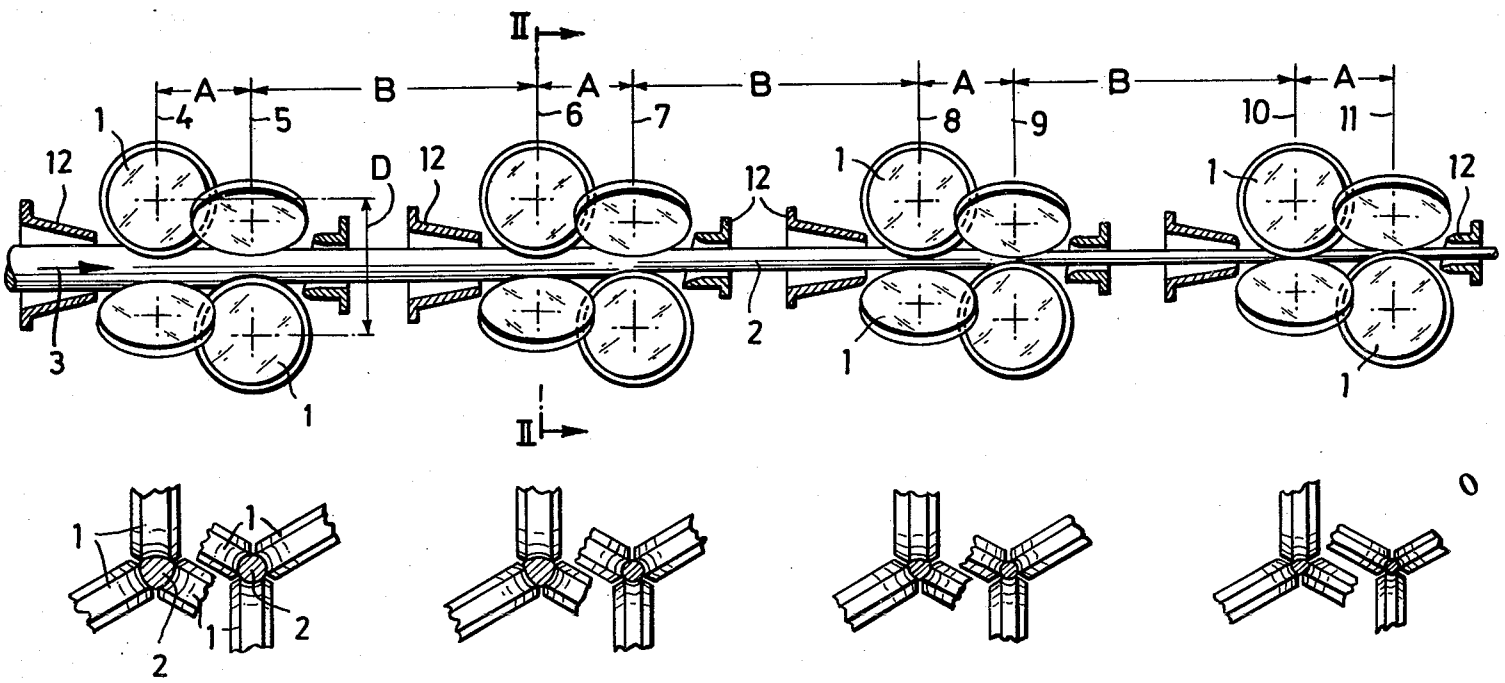
FIG. 1 is a diagrammatic side elevation of a roller arrangement comprising four pairs of sizing passes.
FIG. 1A to 1D are diagrammatic sectional elevations of the four pairs of the sizing passes.
Figure 2:
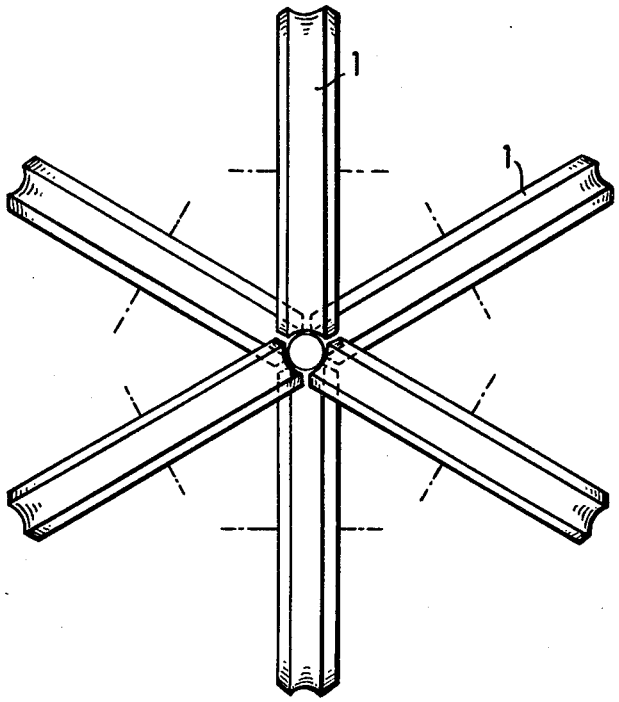
FIG. 2 is a section taken on the line II—II of FIG. 1.

Referring to FIG. 1, the rollers of a rolling mill for a wire or rod-shaped product are designated 1, the bearings and associated roller frames of the rollers not being illustrated. The rollers 1, three of which are arranged with their axes in one plane at each pass, surround the work-material 2 which passes along the rolling axis through the rolling mill in the direction of the arrow 3, that is, from left to right as viewed in FIG. 1 of the drawings.

These planes designated 4 to 11, in each of which are arranged the axes of three respective rollers 1, correspond to the bearing planes of the stands, and the distance between the respective planes 4 to 11 corresponds to the so-called inter-stand spacing. The stand spacing A between the planes 4 and 5 of the first pair of sizing passes is equal to the distance between the planes 6 and 7, 8 and 9, and 10 and 11. In the illustrated embodiment, it corresponds to the external diameter D of the rollers of equal size. This is possible since the rollers of adjoining stands are offset by 60 degrees relative to one another as is shown in FIGS. 1A to 1D and FIG. 2, so that they are not in contact with one another and it is even possible for the inter-stand spacing B provided between the stands of adjoining pairs of sizing passes, namely between the planes 5 and 6, 7 and 8 and 9 and 10 to be greater than the diameter of the rollers. In the embodiment, this stand spacing B corresponds approximately to 2.5 times the diameter D of the rollers.

The associated cross-sectional configurations of the sizing passes are illustrated in FIGS. 1A to 1D below the roller planes 4 to 11. It will be clearly seen that the last sizing pass in front of the larger stand spacing B produces a regular cross-sectional shape, namely a circular cross-sectional shape, whereas the products of the other sizing passes are in the shape of a triangular oval.

By "regular cross-sectional shape" is meant one which has complete symmetry with respect to the following sizing pass, such that the cross-section appears the same whether or not the product or workpiece is turned about the rolling axis through an angle less than the angle between the rollers of that pass. Thus a regular hexagonal or nine or twelve-sided polygonal cross-sectional shape is a regular cross-sectional shape in the case of three-roller stands and a regular octagonal or twelve sided polygonal cross-sectional shape is a regular cross-sectional shape in the case of four roller stands.

As can be seen from FIGS. 1A to 1D, the cross-section of the workpiece emerging from the first pass of each pair is roughly triangular so that it is not a "regular cross-sectional shape". The tendency for the workpiece to turn between the two stands of each pair is minimized by making the inter-stand spacing A between the stand planes not substantially greater than and preferably equal to or less than the roller diameter. The circular cross-sectional shape of the workpiece as it leaves the second pass of each pair makes it unnecessary to take positive measures to prevent twisting over the larger inter-stand spacing B.

A coarse guide 12 is located at the entry into the first roller frame with the plane 4, and at the exit out of the last roller frame with the plane 11, the coarse guides also being arranged in the region of the large stand spacings B. The coarse guides are normally not in contact with the work-material 2 and only provided as a safety precaution lest the work-material cannot break out of the rolling mill. Guide elements which abut closely against the product 2, and which prevent the latter from turning about its longitudinal axis, are not provided anywhere.

In the foregoing specification we have set out certain preferred practices and embodiments of our invention, however, it will be understood that this invention may be otherwise embodied within the scope of the following claims.

We claim:

1. A rolling mill for rolling wire or rod-shaped product without the use of guide elements abutting the work material to prevent rotation of the work material about its longitudinal axis between roll stands comprising a plurality of groups of stands which are arranged one after the other and each of which stands has at least three driven rollers, the distance between at least two adjoining stands forming a group is not substantially greater than the roller diameter of those stands and the last sizing pass of each such group of stands has a regular cross-sectional shape in relation to the first sizing pass of the next following group.

2. A rolling mill as claimed in claim 1, in which each group of stands comprises two roller stands, and in which a larger inter-stand spacing of two to seven times the roller diameter is provided between the groups of stands.

3. A rolling mill as claimed in one of claims 1 and 2, in which the cross-sectional configuration of the sizing passes from roller stand to roller stand in a given group varies between one of the group a triangular oval and a circle and the group a triangle and a hexagon.

4. A rolling mill as claimed in one of claims 1 and 2 in which the last sizing pass of each group has a circular cross section.

5. A rolling mill as claimed in one of claims 1 and 2 in which the distance between the adjoining stands forming a group is equal to or less than the roller diameter.

6. A rolling mill as claimed in one of claims 1 and 2 in which each of the roll stands of each group are three roller stands and the last sizing pass of each group has a regular hexagonal cross section.

7. A rolling mill as claimed in one of claims 1 and 2 in which the cross-sectional configuration of the sizing passes from roller stand to roller stand in a given group varies between one of the group a triangular oval and a circle and the group a triangle and a hexagon and in which the distance between adjoining stands forming a group is no greater than the roller diameter of said stands.

* * * * *